United States Patent [19]

Newton

[11] Patent Number: 4,675,037

[45] Date of Patent: Jun. 23, 1987

[54] APPARATUS AND METHOD FOR RECOVERING LIQUEFIED NATURAL GAS VAPOR BOILOFF BY RELIQUEFYING DURING STARTUP OR TURNDOWN

[75] Inventor: Charles L. Newton, Bethlehem, Pa.

[73] Assignee: Air Products and Chemicals, Inc., Allentown, Pa.

[21] Appl. No.: 830,616

[22] Filed: Feb. 18, 1986

[51] Int. Cl.[4] ..... F25J 3/02

[52] U.S. Cl. ..... 62/28; 62/40; 62/54; 220/85 VR

[58] Field of Search ..... 62/28, 40, 54; 220/85 VR, 85 VS; 55/88

[56] References Cited

U.S. PATENT DOCUMENTS

| | | | |
|---|---|---|---|
| 3,195,316 | 7/1965 | Maher et al. | 62/54 |
| 3,602,002 | 8/1971 | Bailey et al. | 62/54 |
| 3,857,245 | 12/1974 | Jones | 62/54 |
| 3,857,251 | 12/1974 | Alleaume | 62/54 |
| 4,010,779 | 3/1977 | Pollock et al. | 62/54 |
| 4,017,283 | 12/1977 | Witt | 62/54 |
| 4,249,387 | 2/1981 | Crowley | 62/54 |

OTHER PUBLICATIONS

P. Wicker, Sulzer Bros. Ltd., Reliquefaction of LNG Boiloff Gas, The Oil and Gas Journal, Jan. 18, 1971, pp. 53–55.

*Primary Examiner*—Ronald C. Capossela

*Attorney, Agent, or Firm*—Willard Jones, II; J. C. Simmons; E. E. Innis

[57] ABSTRACT

A portion of the boiloff from LNG storage container is revaporized and recycled during reliquefaction process to control the concentration of nitrogen and to provide upper limit temperature control.

4 Claims, 3 Drawing Figures

APPARATUS AND METHOD FOR RECOVERING LIQUEFIED NATURAL GAS VAPOR BOILOFF BY RELIQUEFYING DURING STARTUP OR TURNDOWN

TECHNICAL FIELD

The present invention relates to of a process for reliquefying liquefied natural gas (LNG) boiloff.

BACKGROUND OF THE INVENTION

Heat leakage into the LNG storage container vaporizes some of the liquid phase, increasing the container pressure. In the past, this pressure was relieved by consuming the LNG-containing gases which flashed off as auxiliary fuel to the steam boilers for steam driven LNG tankers. Alternatively, the flashed gas could be purged by venting or flaring when outside of port. Recent LNG tanker designs use diesel engine drives rather than steam driven engines. These new tankers have reliquefiers for recondensing LNG boiloff but and have no method for disposing of the reliquefier purge. Also, regulations prohibit disposal of hydrocarbon-containing streams by venting or flaring, especially while in port. With elimination of these options for controlling the boiloff, it has been proposed to recover the LNG by reliquefying the flashed gas and returning it to the LNG storage container.

During startup and turndown (reduced load) operation of a boiloff reliquefier for an LNG storage container, nitrogen ($N_2$) impurities will flash preferentially from the LNG and concentrate within the vapor system. The primary source of nitrogen impurity is that which is contained originally in the natural gas, usually up to about 0.5 percent. Nitrogen, more volatile than LNG, flashes off preferentially and concentrates within the vapor system. For example, LNG containing 0.3 percent $N_2$ will produce a vapor containing approximately 3% $N_2$.

The reliquefaction of the flashed gas is hampered by the presence of the nitrogen impurity. Under the startup and turndown conditions, the boiloff reliquefier system concentrates nitrogen to the point at which the internal refrigerant system of the reliquefier can not provide sufficient refrigeration at a low enough temperature to reach the dew point of the flashed gas. At this point, reliquefaction ceases until the vapor phase $N_2$ concentration is reduced.

A reliquefaction system is described by P. Wicker of Sulzer Brothers Limited, Switzerland in *Reliquefaction of LNG Boiloff Gas*, The Oil and Gas Journal, 53–55 (Jan. 18, 1971). This system utilizes a refrigerant buffer vessel whereby the refrigeration capacity can be reduced down to 30 percent of design capacity. At the end of page 54, the article outlines an attempted procedure for initial cooldown of the LNG storage tank, but states that such procedure failed. This failure was due to freezeup of the condenser with moisture and heavy hydrocarbons. Such experience demonstrates unanticipated problems when operating far from design conditions.

SUMMARY OF THE INVENTION

The present invention is a process for reliquefying LNG to prevent an increasing gas-phase concentration of nitrogen and to control temperature, by the revaporization and recycling of the reliquefied stream. This process is especially useful under startup and for turndown conditions of the reliquefier.

DETAILED DESCRIPTION OF THE INVENTION

A reliquefaction system is modified so that the composition of the boiloff remains comparatively constant, and does not significantly increase in nitrogen concentration. During the operation of a boiloff reliquefier, reduced load and abnormal vapor composition situations may be encountered leading to malfunctioning of the reliquefier. Various reliquefier operating conditions could lead to reduced vapor flow or increased nitrogen content of the stream from the LNG storage container. For example, these conditions could be reduced storage container liquid inventory during a tanker return journey, unloading a tanker, or when starting up the reliquefier.

In order to prevent the problems of shutdown and restart of the reliquefier, it is proposed to artificially provide a constant load to the reliquefier by revaporization of the condensed vapor.

It is presently estimated that a reliquefier could operate at reduced loads down to 30 percent without shutdown. Thirty percent has been specified for the return trip of a LNG tanker boiloff reliquefier. The use of are revaporizer in the present invention is useful in preventing shutdown of the reliquefier at lower loadings.

A particularly critical operation is reliquefier startup whilst in port. Normal startup would require venting of uncondensed nitrogen from the condenser to maintain the vapor dewpoint above the reliquefier condensation temperature. This venting is not required when vaporized LNG-rich condensate produced during the initial phases of startup is recycled according to the present invention.

Figure 1:
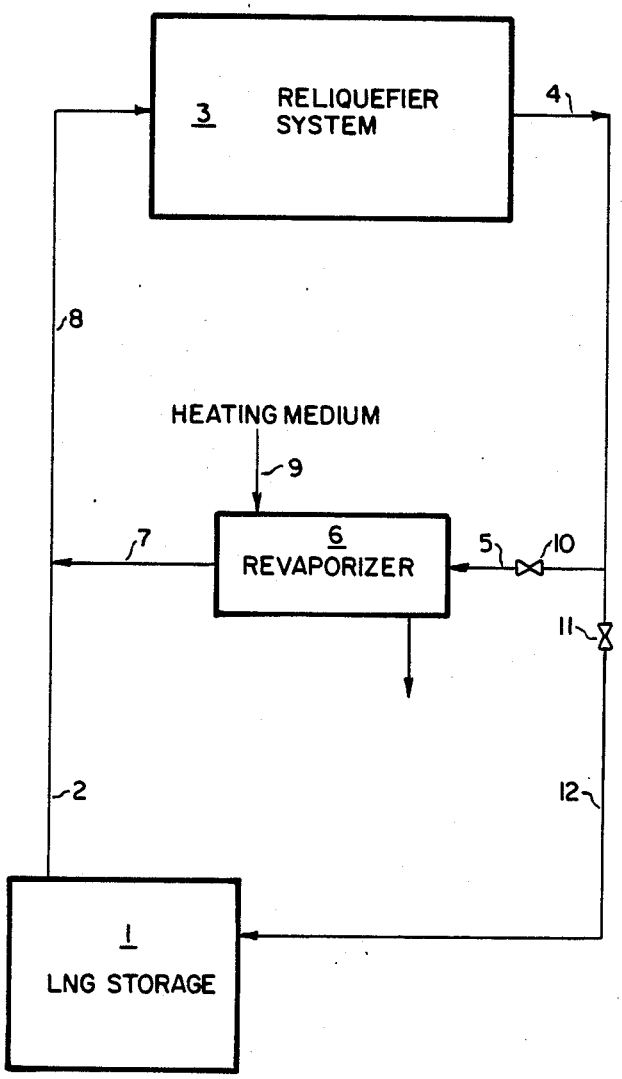
FIG. 1 is a block diagram illustrating the process of revaporizing and recycling reliquefied boiloff according to the present invention.

As show in FIG. 1 the invention comprises the incorporation of a boiloff revaporizer 6 into the LNG reliquefier system. Vapor 2 and 8 from the LNG storage container 1 is normally reliquefied in a reliquefier system 3, as is known in the prior art, and the reliquefier product 4 which is all or predominantly liquid is normally returned to the LNG storage container 1.

Nitrogen flashes off preferentially to other components of the LNG; likewise, other LNG components condense preferentially to nitrogen. When the reliquefier product 4 is not cooled to saturation, especially during startup or turndown operation, any liquid phase in stream product 4 will be richer in LNG and any gas phase in stream product 4 will be richer in nitrogen. Any liquid in product stream 4 which partially flashes upon entrance to the LNG container 1, due to incomplete cooling of the reliquefied boiloff during startup and/or due to the heat leak to the return LNG piping during reliquefier turndown, will also increase the vapor phase concentration of nitrogen in the LNG container 1. According to the present invention, to prevent an increasing concentration of nitrogen in the gas phase, at least a portion of product stream 4 from the reliquefier system 3 is revaporized via stream 5 in revaporizer 6. The revaporized stream 7 is recycled via stream 8 to the reliquefier system 3.

During startup, for example, all of the liquid phase of product stream 4 will be revaporized via stream 5 and the LNG storage container return stream 12 will be comcomitantly decreased. Therefore flow control valve 10 will be open and flow control valve 11 will be closed.

When an increasing amount of what is being condensed in reliquefier 3 is sufficient to maintain a stable nitrogen concentration, control valve 10 will be closed to shut off the recycle stream 5 and control valve 11 will be opened to increase stream 12 to the LNG storage container 1.

Turndown operation of the reliquefier can occur, for example, when the LNG storage container 1 is filled and minimal heat leakage is experienced. Under this turndown condition of low or no gas flow, a control system may be of the type to initiate a compressor recycle stream (not shown), in the reliquefier system, in order to maintain a minimum flowrate thereby preventing compressor surge. The temperature of the stream through the compressor is increased due to the heat of compression. The corresponding increase in temperature of this stream may exceed the equipment operating temperature limits of the reliquefier system. Revaporization (and recycle) of at least a portion of the boiloff stream 4 can be used to increase the flowrate to and to decrease the inlet temperature of the compressor feed by adding stream 7 to the compressor antisurge recycle stream (not shown), thereby preventing overheating of the stream through the compressor. This method can be applied to LNG reliquefier systems which are not contaminated with nitrogen to limit the temperature rise caused by heat of compression and/or heat leak.

The heating medium 9 for revaporizer 6 can be chosen according to general engineering principles well known to one skilled in the art. For example, a tanker may choose to use seawater as the heating medium 9 which supplies the heat of vaporization to the revaporizer 6.

Figure 2:
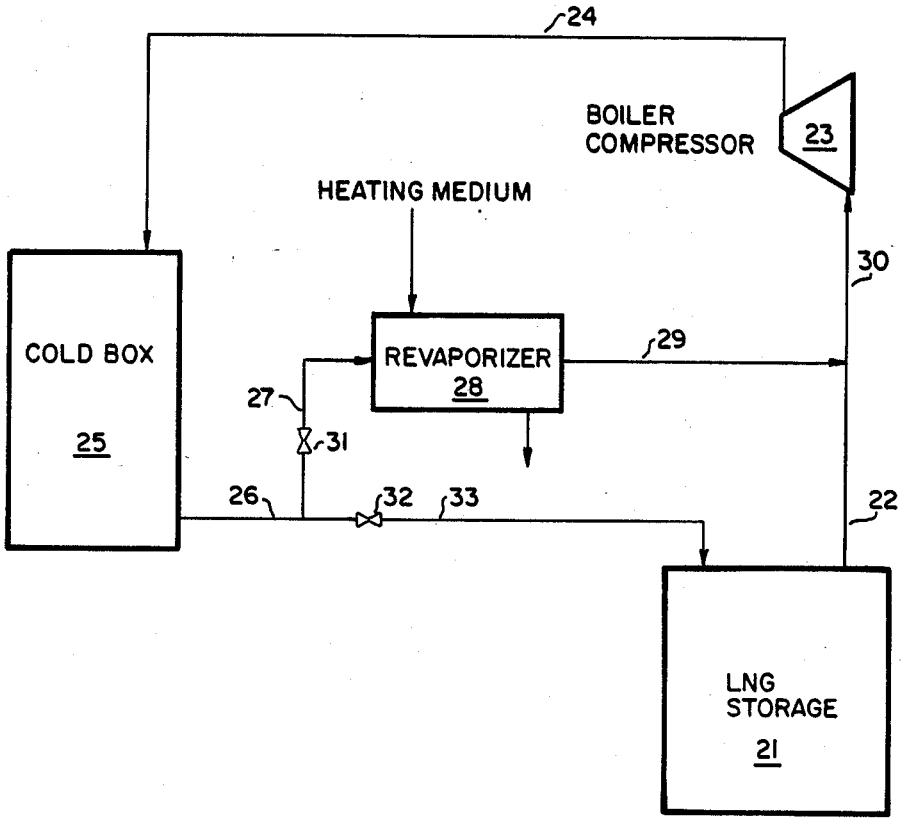
FIG. 2 is a block diagram illustrating another embodiment of the present invention wherein the boiloff is recompressed.

FIG. 2 shows one embodiment of the present invention wherein the reliquefaction system 3 of FIG. 1 is of the type which includes boiloff compressor 23 and cold box 25. In this context, a cold box is an apparatus to condense LNG by heat exchange. The boiloff vapor 22 and 30 from the LNG storage container 21 is compressed in boiloff compressor 23. The compressed vapor 24 is cooled by heat exchange in cold box 25. The cooled liquid product 26 is returned to LNG storage container 21. As the nitrogen concentration of streams 30 and 24 increases, stream 24 becomes more difficult reliquefy. Eventually, reliquefaction ceases. As with the embodiment of FIG. 1, in order to prevent an increasing concentration of nitrogen, initially all and subsequently a portion of liquid in product stream 26 from the cold box 25 is revaporized via stream 27 in revaporizer 28. The revaporized stream 29 is recycled to the boiloff compressor 23 via stream 30.

During startup, for example, all of the liquid phase of product stream 26 will be revaporized via stream 27 and the LNG storage container return stream 33 will be comcomitantly decreased. Therefore flow control valve 31 will be open and flow control valve 32 will be closed.

When an increasing amount of what is being condensed in reliquefier 25 is sufficient to maintain a stable nitrogen concentration, control valve 31 will be closed to shut off the recycle stream 27 and control valve 32 will be opened to increase stream 33 to the LNG storage container 21.

During startup of a conventional reliquefier, the reliquefier equipment is at ambient temperature. Complete revaporization (and recycle) of any boiloff according to the present invention will maintain the nitrogen concentration of the gas at the original boiloff level and permit cool down of the equipment. Revaporization of all of stream 26 should be maintained until stream 26 is completely liquid and subcooled sufficiently to remain a liquid when added to LNG storage container 21.

Turndown operation of the reliquefier can occur, for example, when the LNG storage container 21 is filled and minimal heat leakage is experienced. Under this turndown condition of low or no gas flow, the control system for the compressor 3 may be of the type to initiate a recycle stream (not shown) from its outlet 24 to inlet 30 in order to maintain a minimum flowrate thereby preventing compressor surge. The temperature of the stream through compressor 23 is increased due to the heat of compression. The corresponding increase in temperature of this stream may exceed the equipment operating temperature limits of the cold box 25. Revaporization (and recycle) of at least a portion of the boiloff stream 26 can be used to increase the flowrate to and to decrease the inlet temperature of the compressor feed 30 by adding stream 29 to the antisurge recycle stream (not shown), thereby preventing overheating of the stream through compressor 23. This method can be applied to LNG reliquefier systems which are not contaminated with nitrogen to limit the temperature rise caused by heat of compression and/or heat leak.

The heating medium 31 for revaporizer 28 can be chosen according to general engineering principles well known to those skilled in the art.

Figure 3:
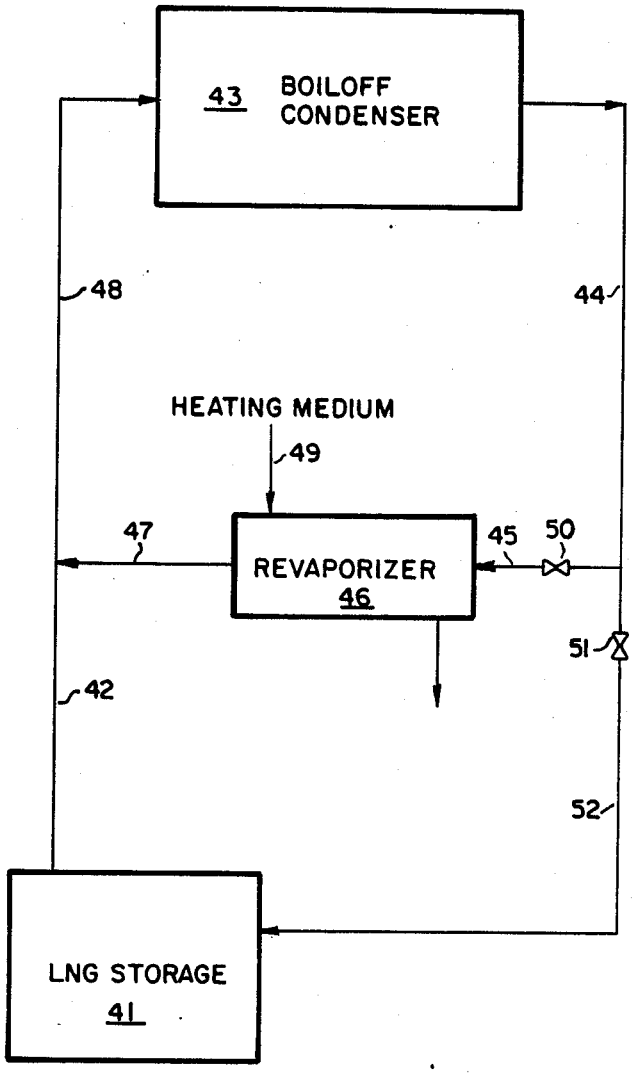
FIG. 3 is a block diagram illustrating yet another embodiment of the present invention wherein the boiloff is recondensed.

FIG. 3 shows another embodiment of the present invention wherein one component of the reliquefaction system 3 of FIG. 1 is a boiloff condenser 43. The boiloff vapor 42 and 48 from the LNG storage container 41 is normally reliquefied in condenser 43 and the resultant boiloff liquid 44 is returned to the LNG storage container 41. As the nitrogen concentration of stream 48 increases during startup or turndown, stream 48 becomes more difficult to reliquefy. Eventually reliquefaction ceases. According to the present invention, to prevent an increasing concentration of nitrogen the portion of liquid in stream 44 from the condenser 43 is revaporized via stream 45 in revaporizer 46. The revaporized stream 47 is recycled to the condenser 43 via stream 48.

As in the system of FIG. 2, during startup of a reliquefier at ambient temperature, nitrogen concentration can be maintained substantially constant by complete revaporization of stream 44 until the equipment has cooled and stream 44 is completely liquid. At this time, control valve 50 will be closed to shut off the recycle stream 45 and control valve 51 will be opened to increase the volume of stream 52 to the LNG storage container 41. Also, nitrogen concentration can be maintained during turndown operation by revaporization and recycle of at least a portion of the reliquefied stream according to the present invention.

Even when the reliquefier system in FIG. 3 contains no compressor, utilization of the revaporizer 46 to artificially maintain a constant load through boiloff condenser 43 will prevent problems associated with reduced or noload conditions on the refrigerant side of the boiloff condenser 43, especially refrigerant compressor problems.

As in the system of FIG. 2, this method can be applied to LNG reliquefier systems which are not contaminated with nitrogen to limit the temperature caused by heat of compression and/or heat leak.

The heating medium 49 for revaporizer 46 can be chosen according to general engineering principles well known to those skilled in the art.

Having thus described my invention what is desired to be secured by Letters Patent of the United States is set forth in the appended claims.

I claim:

1. In a method for recovering vapor boiloff from the vapor space of a liquefied natural gas storage container containing liquefied natural gas and a nitrogen contaminant by feeding a portion of the vapor boiloff to a reliquefier and returning the effluent from the reliquefier to the storage container, the improvement comprising avoiding upsets in the operation of the reliquefier during startup and turndown conditions by:

(a) removing at least a portion of the effluent from the relinquefier to form a recycle product so as to control the concentration of the nitrogen contaminant and/or to limit the temperature rise in the vapor space of the storage container;

(b) warming the recycle product in a revaporizer whereby any condensed portion of the recycle product is vaporized; and (c) returning the recycle product to the inlet of the reliquefier.

2. The method of claim 1 wherein the reliquefier includes a compressor and a cold box and the feed to the revaporizer is the product or a portion thereof from the cold box and the vapor stream from the revaporizer is recycled to the suction of the compressor.

3. The method of claim 1 wherein the reliquefier includes a condenser and the feed to the revaporizer is the product or a portion thereof from the condenser and the vapor from the revaporizer is recycled to the condenser.

4. An apparatus for recovering vapor boiloff from the vapor space of a liquefied natural gas storage container containing liquefied natural gas and a nitrogen contaminant, which plant includes:

(a) a reliquefier for condensing at least a portion of the vapor boiloff from the vapor space of the storage container;

(b) a means for removal of a portion of the effluent from the reliquefier as a recycle product so as to control the concentration of the nitrogen contaminant and/or to limit the temperature rise in the vapor space of the storage container;

(c) a revaporizer for vaporizing any condensed portion of the recycle product; and (d) means for returning the revaporized recycle product to the reliquefier.

* * * * *